United States Patent [19]

Beckner

[11] Patent Number: 5,062,319

[45] Date of Patent: Nov. 5, 1991

[54] SHEET ROLLING MACHINE GUARD APPARATUS

[76] Inventor: Edward A. Beckner, 926 Florida St., Salem, Va. 24153

[21] Appl. No.: 670,181

[22] Filed: Mar. 15, 1991

[51] Int. Cl.[5] ..... F16D 1/02

[52] U.S. Cl. ..... 74/612; 74/609

[58] Field of Search ..... 74/608, 609, 612

[56] References Cited

U.S. PATENT DOCUMENTS

| | | | |
|---|---|---|---|
| 1,643,475 | 9/1927 | Smith, Jr. | 74/612 |
| 2,183,051 | 12/1939 | Stuprich | 74/609 |
| 2,496,544 | 2/1950 | Kee | 74/609 |
| 2,506,610 | 5/1950 | Mueller | 74/612 |
| 2,545,569 | 3/1951 | Buchanan | 74/612 |
| 2,775,905 | 1/1957 | Jackson | 74/609 |
| 3,521,495 | 7/1970 | Schildmeier | 74/609 |
| 3,978,701 | 9/1976 | Rhodes | 74/612 |
| 4,057,990 | 11/1977 | Kelsey et al. | 74/609 |

*Primary Examiner*—Allan D. Herrmann
*Assistant Examiner*—Ryan W. Massey
*Attorney, Agent, or Firm*—Leon Gilden

[57] ABSTRACT

A sheet rolling machine including a plurality of parallel cylindrical rolls has mounted forwardly thereof a guard structure, wherein the guard structure utilizes an upper and lower parallel arrangement of semi-cylindrical members. The members may optionally include adjustable linkage and magnetic mounting means.

5 Claims, 4 Drawing Sheets

SHEET ROLLING MACHINE GUARD APPARATUS

BACKGROUND OF THE INVENTION

1. Field of the Invention

The field of invention relates to a guard apparatus, and more particularly pertains to a new and improved sheet rolling machine guard apparatus wherein the same utilizes forwardly positioned guard structure to minimize danger of operator injury.

2. Description of the Prior Art

Guards of various types have been utilized throughout the prior art. Guard structure for use in rolling type machines requires structure to prevent inadvertent operator clothing or body portions from entering the roller structure. Examples of the prior art include U.S. Pat. No. 2,775,905 to Jackson wherein a semi-cylindrical flexible shield member is mounted overlying a rotary member.

U.S. Pat. No. 3,521,495 to Schildmeier sets forth a further semi-cylindrical type housing to overlie a spinning tire in a wheel balance machine.

U.S. Pat. No. 2,496,544 to Kee sets forth a shield for use in an ironing machine, wherein a quarter cylindrical guard plate is fixedly mounted overlying an entrance to the roller of the device.

U.S. Pat. No. 4,057,990 to Kelsey sets forth a bending apparatus wherein an overlying guard is positioned above an upper cylinder of the deforming apparatus.

As such, it may be appreciated that there continues to be a need for a new and improved sheet rolling machine guard apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of guard apparatus now present in the prior art, the present invention provides a sheet rolling machine guard apparatus wherein the same provides a plurality of readily mounted semi-cylindrical guards in a spaced parallel arrangement to overlie forward surfaces of tandem rolls. As such, the general purpose of the present invention, which will be described subsequently in greater detail, is to provide a new and improved sheet rolling machine guard apparatus which has all the advantages of the prior art guard apparatus and none of the disadvantages.

To attain this, the present invention provides a sheet rolling machine including a plurality of parallel cylindrical rolls mounted forwardly thereof a guard structure, wherein the guard structure utilizes an upper and lower parallel arrangement of semi-cylindrical members. The members may optionally include linkage and magnetic mounting means.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved sheet rolling machine guard apparatus which has all the advantages of the prior art guard apparatus and none of the disadvantages.

It is another object of the present invention to provide a new and improved sheet rolling machine guard apparatus which may be easily and efficiently manufactured and marketed.

It is a further object of the present invention to provide a new and improved sheet rolling machine guard apparatus which is of a durable and reliable construction.

An even further object of the present invention is to provide a new and improved sheet rolling machine guard apparatus which is susceptible of a low cost of manufacture with regard to both materials and labor, and which accordingly is then susceptible of low prices of sale to the consuming public, thereby making such sheet rolling machine guard apparatus economically available to the buying public.

Still yet another object of the present invention is to provide a new and improved sheet rolling machine guard apparatus which provides in the apparatuses and methods of the prior art some of the advantages thereof, while simultaneously overcoming some of the disadvantages normally associated therewith.

Still another object of the present invention is to provide a new and improved sheet rolling machine guard apparatus wherein the same is readily mounted adjustably relative to an associated rolling machine.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3A is a cross section of the rolls with the guard apparatus.

DESCRIPTION OF THE PREFERRED EMBODIMENT

Figure 1:
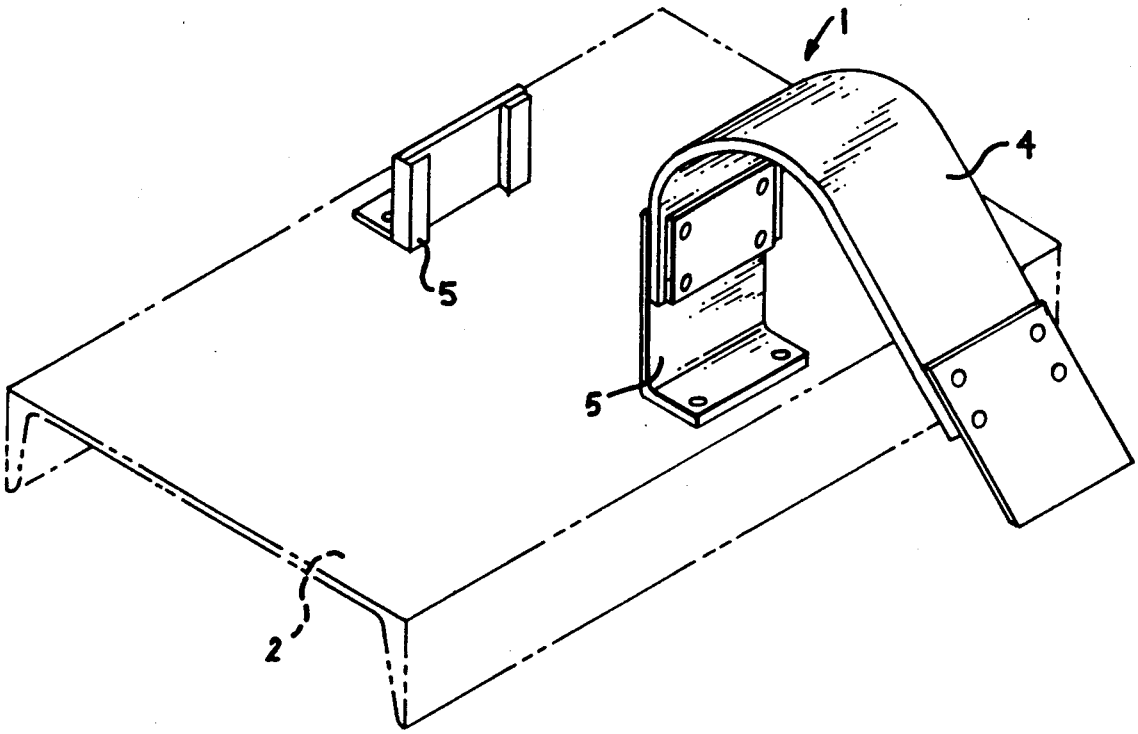
PRIOR ART FIG 1
FIG. 1 is an isometric illustration of a prior art guard apparatus.
Figure 2:
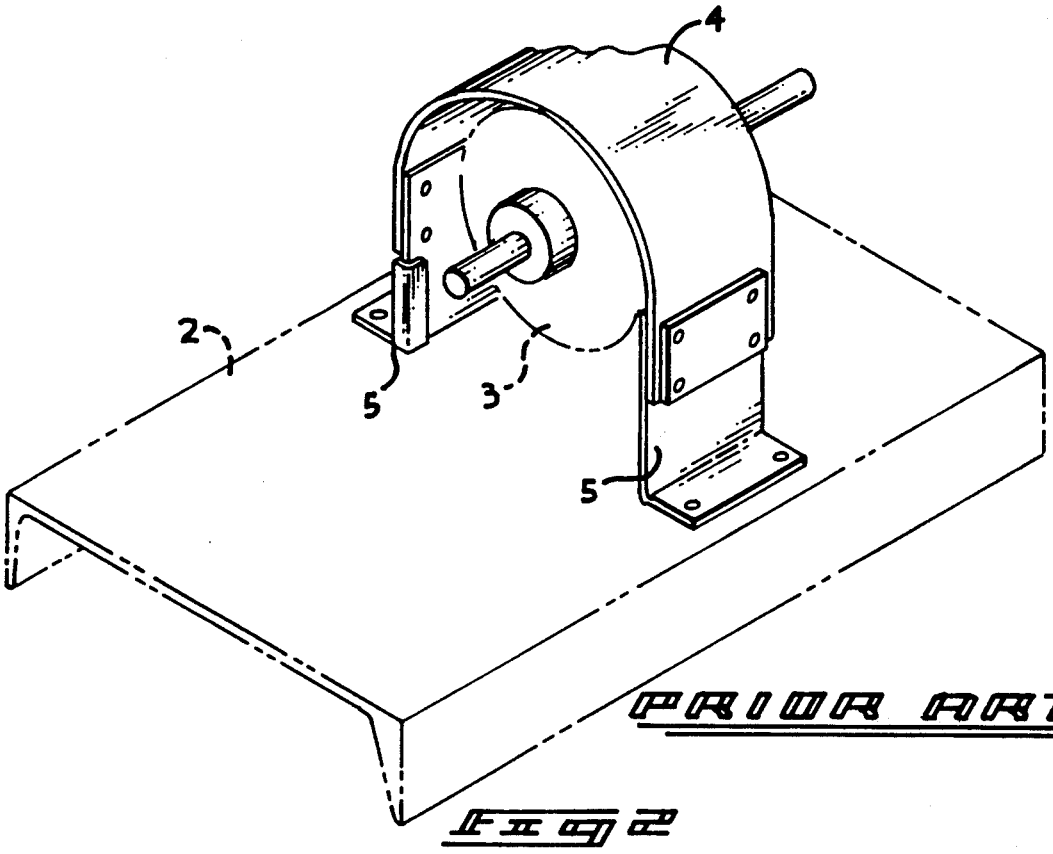
PRIOR ART FIG 2
FIG. 2 is an isometric illustration of the prior art guard apparatus as set forth in FIG. 1 in overlying orientation relative to a coupling.
Figure 4A:
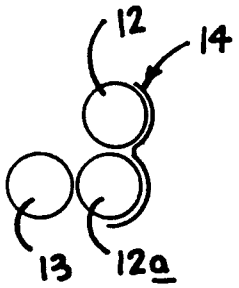
FIG. 4 is an isometric illustration of the guard structure of the instant invention.
Figure 3:
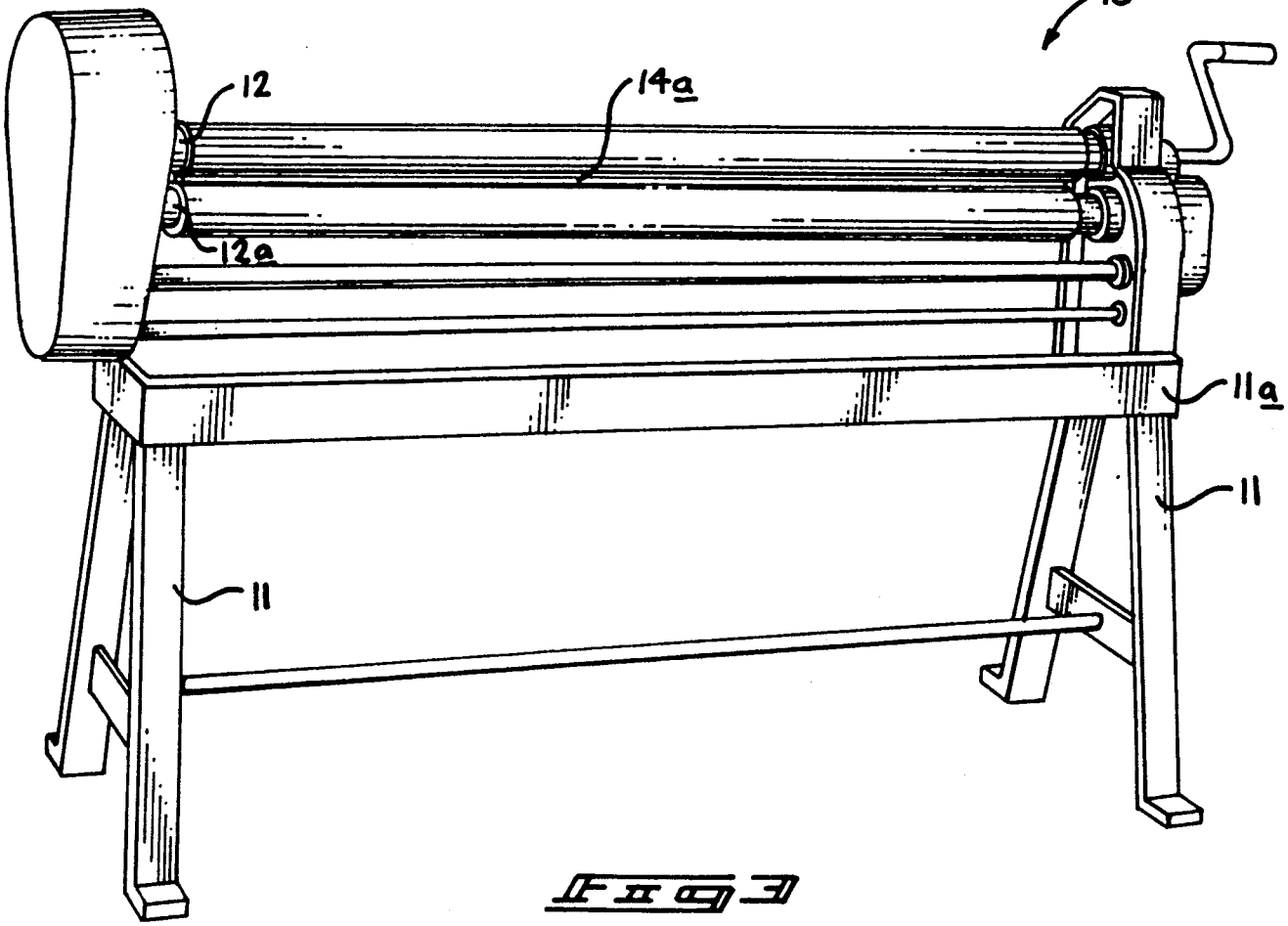
FIG. 3 is an isometric illustration of the instant invention.
Figure 4:
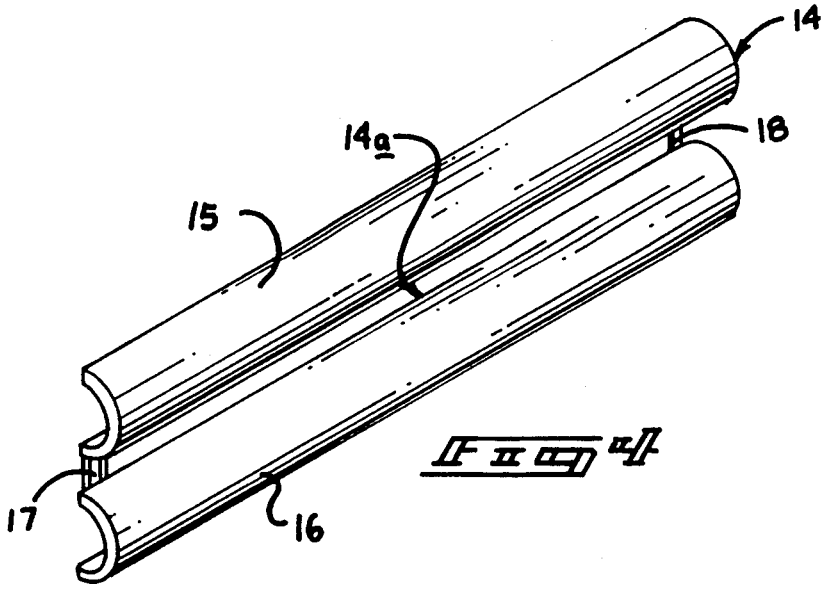

With reference now to the drawings, and in particular to FIGS. 1 to 7 thereof, a new and improved sheet rolling machine guard apparatus embodying the principles and concepts of the present invention and generally designated by the reference numeral 10 will be described.

FIG. 1 illustrates a prior art guard structure 1, wherein a platform 2 mounts a coupling 3, with a plurality of standards 5 mounted in a spaced relationship to position a flexible shield 4 in a semi-circular orientation about the coupling 3 as set forth in U.S. Pat. No. 2,775,905.

More specifically, the sheet rolling machine guard apparatus 10 of the instant invention essentially comprises a plural pair of support legs 11 orthogonally mounted to an underlying support framework 11*a*. The support framework mounts working cylinders including a top roll 12, a bottom roll 12*a*, and an adjustable rear roll 13. The rolls are arranged coextensive and parallel relative to one another. The guard apparatus 14 of the invention includes a top semi-cylindrical shield 15 spaced above and parallel to a bottom semi-cylindrical shield 16 in a spaced relationship to define a gap 14*a* therebetween to permit directing of sheet parts between the top and bottom shields. A first link 17 is mounted between opposed left end portions of the top and bottom shields, with a second link 18 mounted between right internal portions of the top and bottom shields 15 and 16. The links are arranged parallel relative to one another and generally radially aligned with the top and bottom semi-cylindrical shields 15 and 16.

Figure 5:
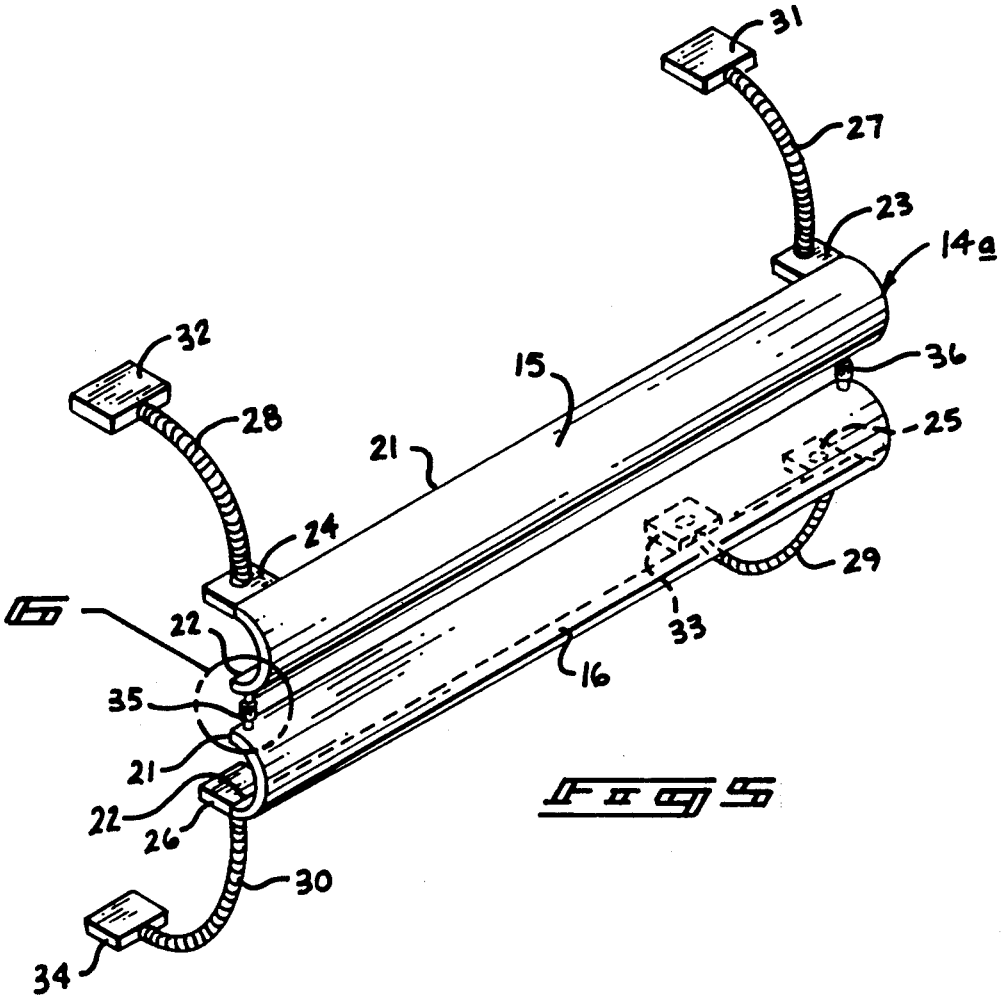
FIG. 5 is an isometric illustration of a modified guard structure of the instant invention.

FIG. 5 illustrates a modified guard apparatus 14*a* utilizing the top and bottom semi-cylindrical shields 15 and 16. The semi-cylindrical shields are further defined by a top linear end 21 and a bottom linear end 22. The linear ends of the top and bottom shields are arranged in a common plane, with a bottom linear end of the top shield 15 oriented adjacent a top linear end of the bottom shield 16. Respective first and second adjustable links 35 and 36 are mounted adjacent opposed left and right terminal end portions of the adjacent top and bottom linear ends of the top and bottom shields 15 and 16, as illustrated in FIG. 5 for example. The top linear end 21 of the top shield 15 includes a support plate 23 and a second support plate 24 positioned adjacent opposed right and left terminal ends of the top linear end 21. The bottom linear end 22 of the bottom shield 16 includes a respective third and fourth support plate 25 and 26 mounted adjacent opposed right and left terminal ends of the bottom linear end 22 of the bottom shield 16. It is noted that the first and fourth support plates are parallel, while the second and third support plates are also parallel relative to one another. The first and second support plates are defined in a first plane, while the third and fourth support plates define in a second plane and it is understood that the planes are generally parallel relative to one another. A planar first and second deformable goose neck member 27 and 28 are respectively mounted to top surfaces of the respective first and second support plates 23 and 24. Accordingly, respective second and third deformable goose neck members 28 and 29 are fixedly mounted to bottom surfaces of the third and fourth support plates 25 and 26. Each respective first through fourth goose neck member mounts a respective first, second, third, and fourth respective ferromagnetic plate 31, 32, 33, and 34 at each terminal end of each respective goose neck member. The ferromagnetic plates permit positioning and attachment to the support frame 11*a* of the sheet rolling machine.

Figure 6:
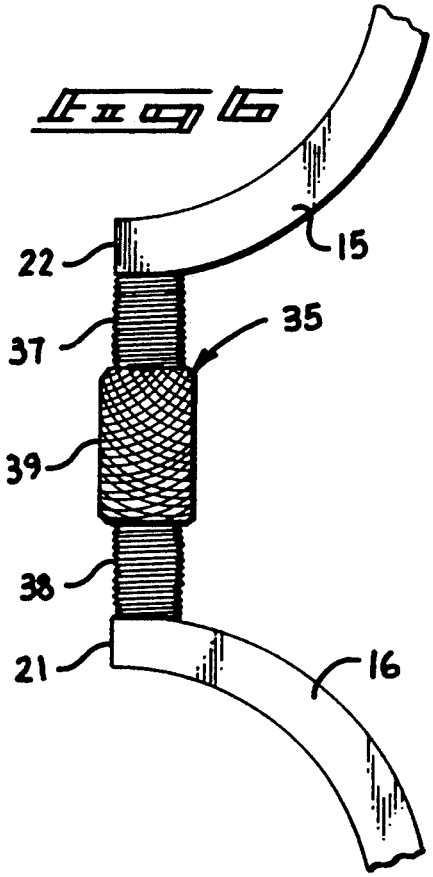
FIG. 6 is an orthographic side view of Section 6 as set forth in FIG. 5.
Figure 7:
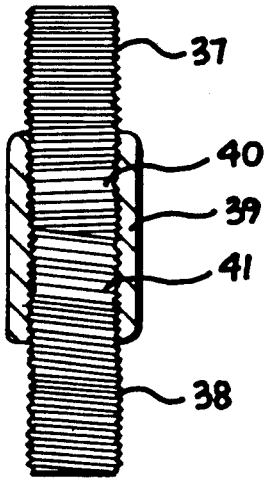
FIG. 7 is an orthographic cross-sectional illustration of the adjustable guard rod and sleeve structure utilized by the instant invention.

FIGS. 6 and 7 are illustrative of the adjustable link members 35 and 36 of equal construction. For purposes of example, the first adjustable link 35 is illustrated, including an upper rod 37 defined by a right hand thread mounted adjacent the bottom linear end of the top shield 15, with the lower rod 38 utilizing a left hand thread mounted to the top linear end 21 of the bottom shield 16. The upper and lower rods 37 and 38 are coaxially aligned relative to one another and are threadedly receivable within an internally threaded sleeve 39. The internally threaded sleeve includes a roughened grasping surface exteriorly thereof to enhance manual grasping, and including an upper right hand sleeve thread 40 directed through an upper interior portion of the sleeve 39, with a left hand sleeve thread 41 directed through a lower portion of the sleeve to accommodate the respective upper and lower rods 37 and 38. Accordingly, rotation of the sleeve 39 effects simultaneous widening or narrowing of the gap 14*a*.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A sheet rolling machine guard apparatus comprising, in combination, a support framework, the support framework mounting a top roll spaced from and parallel a bottom roll, and a rear roll mounted rearwardly of and parallel the bottom roll, and a guard member including a top semi-cylindrical shield spaced above a bottom semi-cylindrical shield defining a gap therebetween, the top semi-cylindrical shield positioned forwardly of the top roll and the bottom semi-cylindrical shield positions forwardly of the bottom roll, with the top and bottom roll defining a roll gap, wherein the gap is substantially aligned with the roll gap, and the top shield including a top shield top linear end and a top shield bottom linear end, the bottom shield including a bottom shield top linear end and a bottom shield bottom linear end, wherein each linear end is arranged in a single plane, and a first link mounted adjacent the top shield bottom linear end and the bottom shield top linear end, and a second link mounted to the top shield bottom linear end and the bottom shield top linear end, wherein the first and second links are arranged parallel relative to one another and mounted adjacent opposed ends of the gap defined by the top and bottom shields.

2. An apparatus as set forth in claim 1 wherein the first link and the second link are adjustable.

3. An apparatus as set forth in claim 2 wherein each link includes an upper rod mounted to the top shield bottom end edge and a bottom rod mounted to the bottom shield top end edge, wherein the upper and lower rods are coaxially aligned relative to one another, and the upper rod is defined by a right hand thread and the lower rod is defined by a left hand thread, and an internally threaded sleeve with confronting ends of the upper and lower rods.

4. An apparatus as set forth in claim 3 wherein the internally threaded sleeve includes an internally threaded right hand sleeve thread directed through an upper internal portion of the sleeve and a left hand thread portion directed through the bottom internal surface of the sleeve to permit simultaneous narrowing or widening of the gap upon rotation of the sleeve relative to the upper and lower rods.

5. An apparatus as set forth in claim 4 wherein the top shield top end edge includes respective first and second support plates mounted at opposed lateral ends of the top shield top end edge, and the bottom shield bottom end edge including a respective third and fourth support plate mounted to opposed ends of the bottom shield bottom end edge, wherein the first and second support plates are of a first plane and the third and fourth support plates are of a second plane, and the first and second planes are parallel relative to one another, and each of the first and second support plates includes a respective first and second deformable elongate member mounted fixedly thereto, and the third and fourth support plates include a respective third and fourth deformable member mounted to a bottom surface of the respective third and fourth support plates, and each deformable member includes a ferromagnetic plate mounted to each deformable member remote from a respective support plate permitting the ferromagnetic plates to be selectively securable to the support framework.

* * * * *